US007399193B1

(12) United States Patent
Ho et al.

(10) Patent No.: US 7,399,193 B1
(45) Date of Patent: Jul. 15, 2008

(54) CONNECTOR FOR FLEXIBLE PRINTED CIRCUIT

(75) Inventors: Hsin-Tsung Ho, Taipei Hsien (TW); Yun-Chien Lee, Taipei Hsien (TW); Chung-Hsin Huang, Taipei Hsien (TW); Mei-Chuan Yang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/935,701

(22) Filed: Nov. 6, 2007

(51) Int. Cl.
*H01R 13/15* (2006.01)
*H01R 13/62* (2006.01)
*H01R 12/24* (2006.01)

(52) U.S. Cl. ..... 439/260; 439/495

(58) Field of Classification Search ..... 439/260, 439/261, 495

See application file for complete search history.

(56) References Cited

U.S. PATENT DOCUMENTS 6,254,406 B1 * 7/2001 Chiu et al. ..... 439/142
6,280,217 B1 * 8/2001 Lin ..... 439/260
6,755,682 B2 * 6/2004 Kunishi et al. ..... 439/495
7,189,104 B1 * 3/2007 Gillespie et al. ..... 439/495

* cited by examiner

*Primary Examiner*—Hae Moon Hyeon
(74) *Attorney, Agent, or Firm*—WPAT, P.C.; Anthony King

(57) ABSTRACT

A connector includes an insulating housing, a plurality of terminals, an actuator and a support member. The insulating housing defines a mouth and a plurality of cavities for receiving the corresponding terminals. The actuator is rotatably mounted to the mouth of the insulating housing and has a base. Two opposite sides of the base respectively define an incline slightly sloping inward from bottom to top. A top of the incline protrudes sideward to form an edge. The support member has a base section. A top of the base section bends sideward to form an arcuate section. A free end of the arcuate section extends downward to form an elastic section. While the actuator is at a closed position, the elastic section and the corresponding incline buckle with each other, the edge is held by the arcuate section.

6 Claims, 3 Drawing Sheets

CONNECTOR FOR FLEXIBLE PRINTED CIRCUIT

BACKGROUND OF THE INVENTION

1. Field of the Invention

The present invention generally relates to an electrical connector, and more particularly to an electrical connector for a flexible printed cable or a flexible printed circuit (FPC hereinafter for simplification), having a pair of support members capable of making an actuator closed firmly.

2. The Related Art

An FPC connector shown in U.S. Pat. No. 7,189,104 includes an insulating housing, a plurality of terminals, an actuator and a pair of support members. The insulating housing defines a plurality of terminal cavities. The terminal is received in the corresponding terminal cavity. The support members are respectively fixed at two opposite ends of the insulating housing. The support member has a base section, a soldering section bends sideward from a bottom of the base section and an inserting section extends rearward from a rear of the base section. The actuator is of rectangular shape and is rotatably mounted in the insulating housing.

After inserting an FPC in the connector, the actuator can stably pivot from an open position to a closed position. While at the closed position, the FPC connector holds the actuator by the base section of the support member. However, the compression strength between the actuator and the two support members can't hold the actuator firmly, so that the actuator is apt to open.

SUMMARY OF THE INVENTION

An object of the present invention is to provide an FPC connector, which can make an actuator closed firmly.

The FPC connector includes an insulating housing, a plurality of terminals, an actuator and a support member. The insulating housing has a top wall, a bottom wall, a rear wall and two sidewalls. A mouth is formed among the top wall, the bottom wall, the rear wall and the two sidewalls and passes through a front of the top wall. Two sides of the bottom wall respectively define a fixing groove at front. The insulating housing defines a plurality of cavities, the terminals are received in the corresponding cavities of the insulating housing. The actuator is rotatably mounted to the mouth of the insulating housing and has a base. Two opposite sides of the base respectively define an incline slightly sloping inward from bottom to top. A top of the incline protrudes sideward to form an edge. The support member has a base section. A bottom of the base section extends downward to form a soldering section plugged into the corresponding fixing groove of the insulating housing. A top of the base section bends sideward to form an arcuate section. A free end of the arcuate section extends downward to form an elastic section. After inserting an FPC in the connector, the actuator can stably pivot from an open position to a closed position. While at the closed position, the elastic section and the corresponding incline of the actuator buckle with each other, the edge of the actuator is held by the arcuate section.

As described above, while the actuator is at the closed position, an outer surface of the elastic section matches with the corresponding incline and the edges are held by the arcuate sections. The buckle force between the incline and the corresponding elastic section can prevent the actuator from overturning upward to ensure that the actuator is closed firmly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
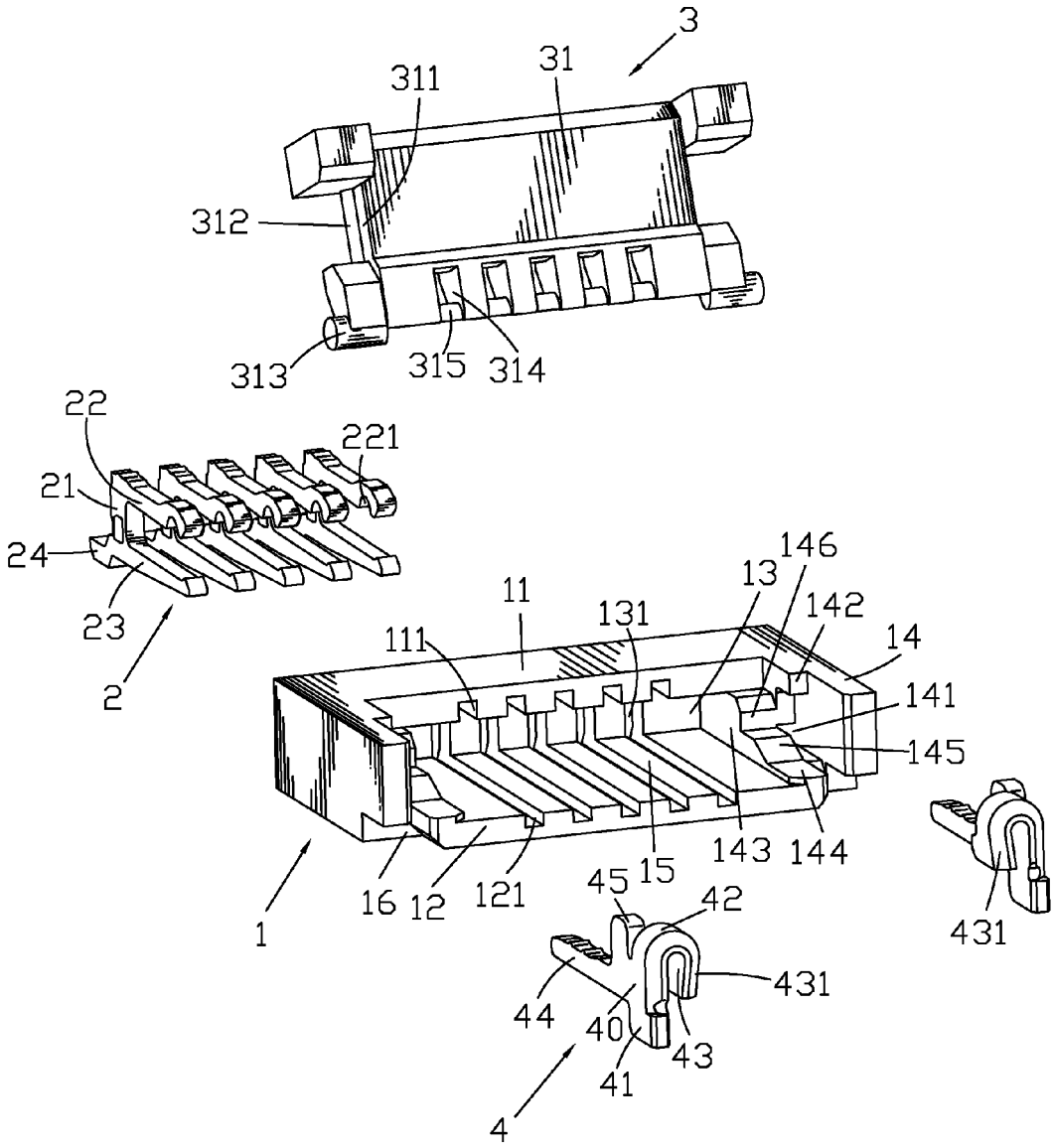
FIG. 1 is an exploded perspective view of an FPC connector in accordance with the present invention.

With reference to FIG. 1, an FPC connector includes an insulating housing 1, a plurality of terminals 2, an actuator 3 and a pair of support members 4.

The insulating housing 1 is of rectangular shape and has a top wall 11, a bottom wall 12, a rear wall 13 and two sidewalls 14. A front of the top wall 11 is transversely cut off, and accordingly, a mouth 15 is formed among the top wall 11, the bottom wall 12, the rear wall 13 and the two sidewalls 14. The inside of the top wall 11 defines a plurality of top cavities 111 arranged at regular intervals passing through a front and rear thereof and the inside of the bottom wall 12 defines a plurality of bottom cavities 121 in accordance with the top cavities 111. Accordingly, a plurality of rear cavities 131 are defined on an inner surface of the rear wall 13 to communicate with both the corresponding top cavities 111 and the corresponding bottom cavities 121 in a vertical direction. Two sides of the bottom wall 12 respectively protrude upward to form a ladder portion 143 apart from the corresponding sidewall 14. A front of the ladder portion 143 defines a first support portion 144 and a second support portion 145, which locates in the front of the mouth 15. The second support portion 145 locates at the rear of the first support portion 144 and is higher than the first support portion 144. The ladder portion 143 has a protrusion 146 at the rear of the second support portion 145 and is higher than the second support portion 145. The protrusion 146 transversely extends outward to connect with the corresponding sidewall 14. An aperture 141 extends rearward from the bottom of a front surface of the protrusion 146 to pass through the rear wall 13 and locates between the second support portion 145 and the corresponding sidewall 14. Two sides of the top wall 11 protrude forward to form a block 142 adjacent to the corresponding sidewall 14 respectively. Two sides of the bottom wall 12 respectively define a fixing groove 16 at front.

Each of the terminals 2 has a base portion 21. A top of the base portion 21 extends forward to form a bearing portion 22, a free end of the bearing portion 22 bends upward and then bends reversely to form a locking portion 221. A bottom of the base portion 21 extends forward to form a contact portion 23 substantially paralleling with the bearing portion 22 and extends rearward to form a soldering foot 24.

Figure 4:
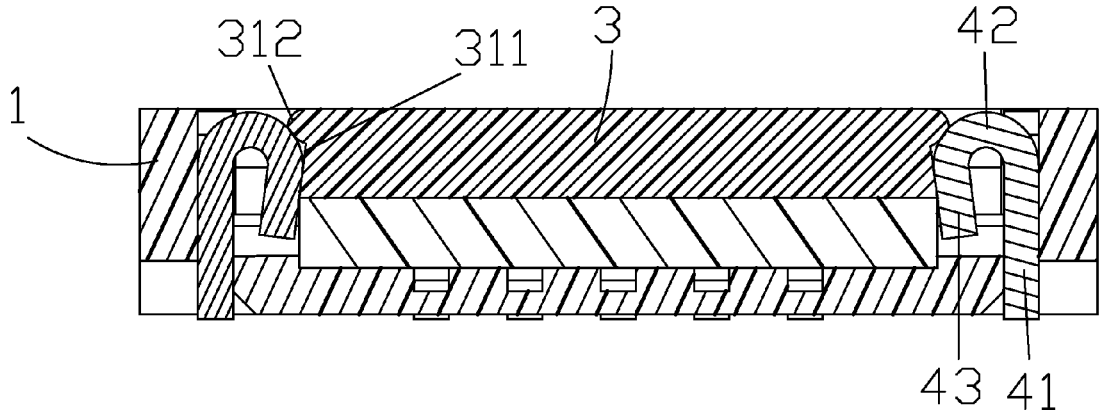
FIG. 4 is a transverse cross-sectional view of the FPC connector, wherein the flexible printed circuit board is inserted and the actuator is placed at a closed position.

Referring to FIG. 1 and FIG. 4, the actuator 3 has a flat base 31. Two opposite sides of the base 31 respectively define a pair of projections at two ends thereof. An incline 311 is defined between the projections and slightly slopes inward from bottom to top. A top of the incline 311 protrudes sideward to form an edge 312 having an arc-shaped cross-section. Two ends of a rear of the base 31 respectively protrude sideward to form a pillar-shaped boss 313. The rear of the base 31 defines a plurality of locking holes 314 passing through a top and bottom thereof and arranged at regular intervals along the longwise direction thereof. Accordingly, a plurality of beams 315 are formed at the rear of the locking holes 314 to cooperate with the locking portion 221 of the terminal 2.

Referring to FIG. 1 and FIG. 4, each of the support members 4 has a base section 40. A bottom of the base section 40 extends downward to form a soldering section 41. A top of the base section 40 bends sideward to form an arcuate section 42. A free end of the arcuate section 42 extends downward and then protrudes a little rearward to form an elastic section 43 leaning a little toward the base section 40. A front of the elastic section 43 defines a smooth surface 431 slightly sloping sideward from front to rear. A rear of the base section 40 extends rearward to form an inserting section 44 mating with the aperture 141 of the insulating housing 1 and a front end of the inserting section 44 extends upward to form a preventing section 45 adjacent to the arcuate section 42.

Figure 2:
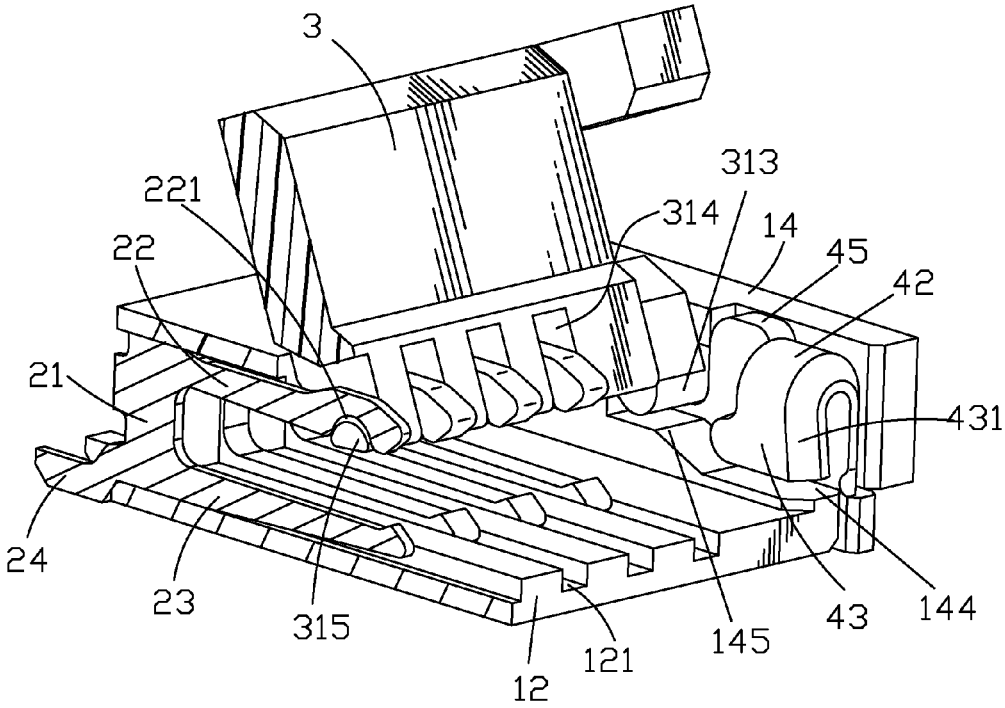
FIG. 2 is a longitudinal cross-sectional view of the FPC connector, wherein an actuator is placed at an open position.

Referring to FIG. 2, the base portion 21 of the terminal 2 is received in the rear cavity 131 of the insulating housing 1. The bearing portion 22 is received in the top cavity 111 and the locking portion 221 stretches out from the front of the top wall 11. The contact portion 23 is received in the bottom cavity 121 and the soldering foot 24 stretches out from a rear of the rear wall 13 and is soldered to a circuit board (not shown). The actuator 3 is rotatably mounted to the mouth 15 of the insulating housing 1. The locking portion 221 inserts into the corresponding locking hole 314 and buckles up the corresponding beam 315. The boss 313 locates at the top of the second support portion 145 and under the block 142 of the insulating housing 1. The soldering section 41 of each support member 4 is plugged into the corresponding fixing groove 16 of the insulating housing 1 and the elastic section 43 locates at the top of the first support portion 144 of the insulating housing 1. The inserting section 44 is inserted into the aperture 141 of the insulating housing 1 and the preventing section 45 tightly abuts against a front of the block 142. Accordingly, a fixing aperture is surrounded by the block 142, the ladder portion 143, the inserting section 44 and the preventing section 45, and the boss 313 of the actuator 3 is rotatably mounted in the fixing aperture to ensure that the actuator 3 can be placed at open or closed positions.

Figure 3:
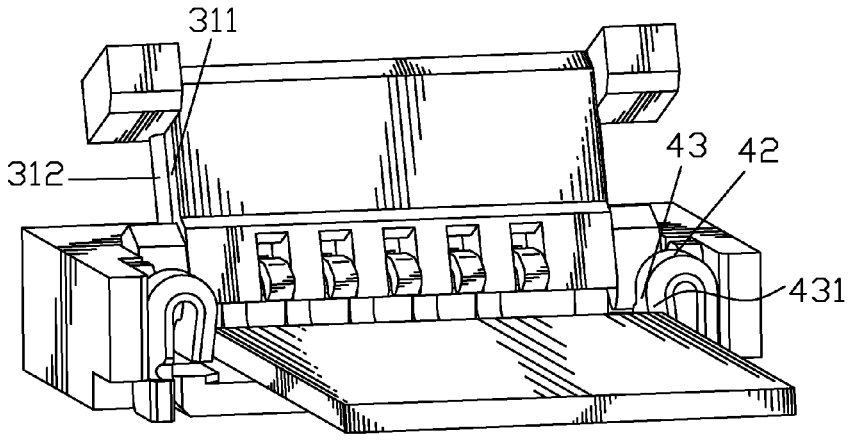
FIG. 3 is a perspective view showing a flexible printed circuit board inserted in the FPC connector, wherein the actuator is placed at the open position.

Referring to FIG. 3 and FIG. 4, a flexible printed circuit board is inserted between the two ladder portions 143 of the insulating housing 1 along the smooth surfaces 431 of the support members 4. During closing the actuator 3, the actuator 3 moves downward along outer surfaces of the elastic sections 43 of the support members 4 until the edge 312 abuts against the arcuate section 42. When the actuator 3 is at a closed position, the outer surface of the elastic section 43 matches with the corresponding incline 311, the edges 312 are held by the arcuate sections 42. The buckle force between the incline 311 and the corresponding elastic section 43 can prevent the actuator 3 from overturning upward to ensure that the actuator 3 is closed firmly.

As described above, the smooth surface 431 of the support member 4 can guide the flexible printed circuit board to insert into the FPC connector. While the actuator 3 is at the closed position, the incline 311 and the corresponding elastic section 43 can buckle with each other tightly and the edges 312 are held by the arcuate sections 42, so that the actuator 3 can be firmly closed.

What is claimed is:

1. A connector, comprising:

an insulating housing having a top wall, a bottom wall, a rear wall and two sidewalls, a mouth formed among the top wall, the bottom wall, the rear wall and the two sidewalls and passing through a front of the top wall, two sides of the bottom wall respectively defining a fixing groove at front, the insulating housing defining a plurality of cavities;

a plurality of terminals received in the cavities of the insulating housing;

an actuator, rotatably mounted to the mouth of the insulating housing, having a base, two opposite sides of the base respectively defining an incline slightly sloping inward from bottom to top, a top of the incline protruding sideward to form an edge; and a support member having a base section, a soldering section extending downward from a bottom of the base section and plugged into the corresponding fixing groove of the insulating housing, a top of the base section bending sideward to form an arcuate section, a free end of the arcuate section extending downward to form an elastic section, the elastic section and the corresponding incline of the actuator buckling with each other and the edge of the actuator held by the arcuate section.

2. The connector as claimed in claim 1, wherein a front of the elastic section of the support member defines a smooth surface slightly sloping sideward from front to rear for guiding an flexible printed circuit (FPC) to insert into the connector.

3. The connector as claimed in claim 1, wherein the front of two sides of the bottom wall forms a first support portion apart from the corresponding sidewall respectively, a bottom of the elastic section of the support member is against the corresponding first support portion.

4. The connector as claimed in claim 1, wherein two sides of the bottom wall respectively protrude upward to form a second support portion apart from the corresponding sidewall, a protrusion is defined at the rear of the second support portion and is higher than the second support portion, the protrusion transversely extends outward to connect with the corresponding sidewall, an aperture extends rearward from the bottom of a front surface of the protrusion and locates between the second support portion and the corresponding sidewall, a rear of the base section of the support member extends rearward to form an inserting section inserted into the aperture of the insulating housing.

5. The connector as claimed in claim 4, wherein two sides of the top wall of the insulating housing respectively protrude forward to form a block adjacent to the corresponding sidewall, a front end of the inserting section of the support member extends upward to form a preventing section adjacent to the arcuate section, the preventing section abuts against a front of the block, accordingly a fixing aperture is surrounded by the inserting section, the preventing section, the block and the protrusion, two ends of a rear of the base of the actuator respectively protrude sideward to form a pillar-shaped boss and the boss is rotatably mounted in the fixing aperture.

6. The connector as claimed in claim 1, wherein the edge of the actuator has an arc-shaped cross-section.

* * * * *